US005482376A

United States Patent [19]

Moseley et al.

[11] Patent Number: 5,482,376

[45] Date of Patent: Jan. 9, 1996

[54] LOAD CARRYING BAG WTIH PERFORATED TEAR LINE OPENING

[75] Inventors: Angela L. Moseley; Gay A. Hoag; George W. Durbin, all of Tomah, Wis.

[73] Assignee: Union Camp Corporation, Wayne, N.J.

[21] Appl. No.: 167,757

[22] Filed: Dec. 15, 1993

[51] Int. Cl.[6] ..... B65D 33/06; B65D 33/16

[52] U.S. Cl. ..... 383/209; 383/25

[58] Field of Search ..... 383/207, 208, 383/209, 67, 25

[56] References Cited

U.S. PATENT DOCUMENTS

| | | | |
|---|---|---|---|
| 2,093,974 | 9/1937 | Farmer . | |
| 2,125,318 | 8/1938 | Salfisberg . | |
| 2,305,428 | 12/1942 | Johnson . | |
| 2,349,369 | 5/1944 | Norseen . | |
| 2,499,528 | 3/1950 | Reitzes . | |
| 2,541,674 | 2/1951 | Snyder . | |
| 2,622,986 | 12/1952 | Snyder et al. . | |
| 2,779,462 | 1/1957 | Hoag . | |
| 2,881,078 | 4/1959 | Oritt . | |
| 2,923,404 | 2/1960 | Adell . | |
| 3,146,912 | 9/1964 | Twersky . | |
| 3,224,640 | 12/1965 | Schneider et al. . | |
| 3,387,701 | 6/1968 | Schneider et al. . | |
| 3,480,198 | 11/1969 | Repko . | |
| 4,557,385 | 12/1985 | Robinson | 383/208 |
| 4,911,562 | 3/1990 | Mazzeschi . | |
| 4,913,293 | 4/1990 | Sanders . | |
| 5,036,978 | 8/1991 | Frank et al. . | |
| 5,121,995 | 8/1992 | Newman et al. . | |
| 5,127,065 | 6/1992 | Wade . | |
| 5,219,229 | 6/1993 | Sengewald . | |
| 5,248,040 | 9/1993 | DeMatteis et al. | 383/209 |
| 5,290,104 | 3/1994 | Sengewald | 383/25 |

*Primary Examiner*—Stephen P. Garbe
*Attorney, Agent, or Firm*—Pennie & Edmonds

[57] ABSTRACT

A bag of plastic construction for carrying substantial loads. The bag includes a perforated tear line with the perforations cut along a substantially arcuate shape at the corner of the bag.

26 Claims, 2 Drawing Sheets

LOAD CARRYING BAG WTIH PERFORATED TEAR LINE OPENING

FIELD OF THE INVENTION

This invention relates to large bags that need to support substantial loads, such as salt pellets, fertilizer, granulated contents, etc. Such bags when filled must be able to resist tearing or bursting when dropped or mishandled during transportation and storage. Also, such bags must also be easy to open by the user.

BACKGROUND OF THE INVENTION

It is known in the prior art that perforated bags have problems with spillage. U.S. Pat. No. 3,146,912 to Twersky teaches a package with a non-perforated opening zone. This opening zone has a plurality of truncated pyramid shaped or arcuate tear lines that are impressed on the bag. U.S. Pat. No. 2,641,674 to Snyder teaches that perforated seals lack strength and are prone to opening accidentally. Snyder '674 also teaches that heat sealed bags are difficult to open. U.S. Pat. No. 5,036,978 to Frank et al. discloses a rectangular bag for carrying compressed diapers having a rectangular shaped perforated opening zone. Larger plastic bags having a size on the order of the bag of the present invention have also been made with perforated tear lines. These bags, however, have been used as liners for containers; and as such they are not suitable for separately supporting heavy loads. Also, the perforation line of these liner bags generally forms a rectangular corner of the bag which can be torn away, the shape being similar to the shape defined in the above-mentioned Snyder patent by the perforation 21 and the left side of the notch segment 20.

The prior art does not teach any bag with a perforated tear line that is capable of carrying a heavy load while at the same time easy to open.

SUMMARY OF THE INVENTION

The present invention provides a novel bag that is capable of carrying heavy loads without tearing or bursting when dropped or mishandled during transportation or storage. Also, the bag is easily opened without the aid of mechanical means, and the contents can be easily emptied. Further, the present invention provides a bag that resists puncturing during the loading process.

In accordance with the present invention, the bag is constructed of plastic material and is provided with a tear line at the corner of the bag. The tear line is defined by perforations which extend in a substantially arcuate path or shape from the upper edge of the bag to the side edge. The perforations are constructed to withstand dropping and mishandling yet permit easy manual opening by the user.

DETAILED DESCRIPTION OF THE INVENTION

Figure 1:
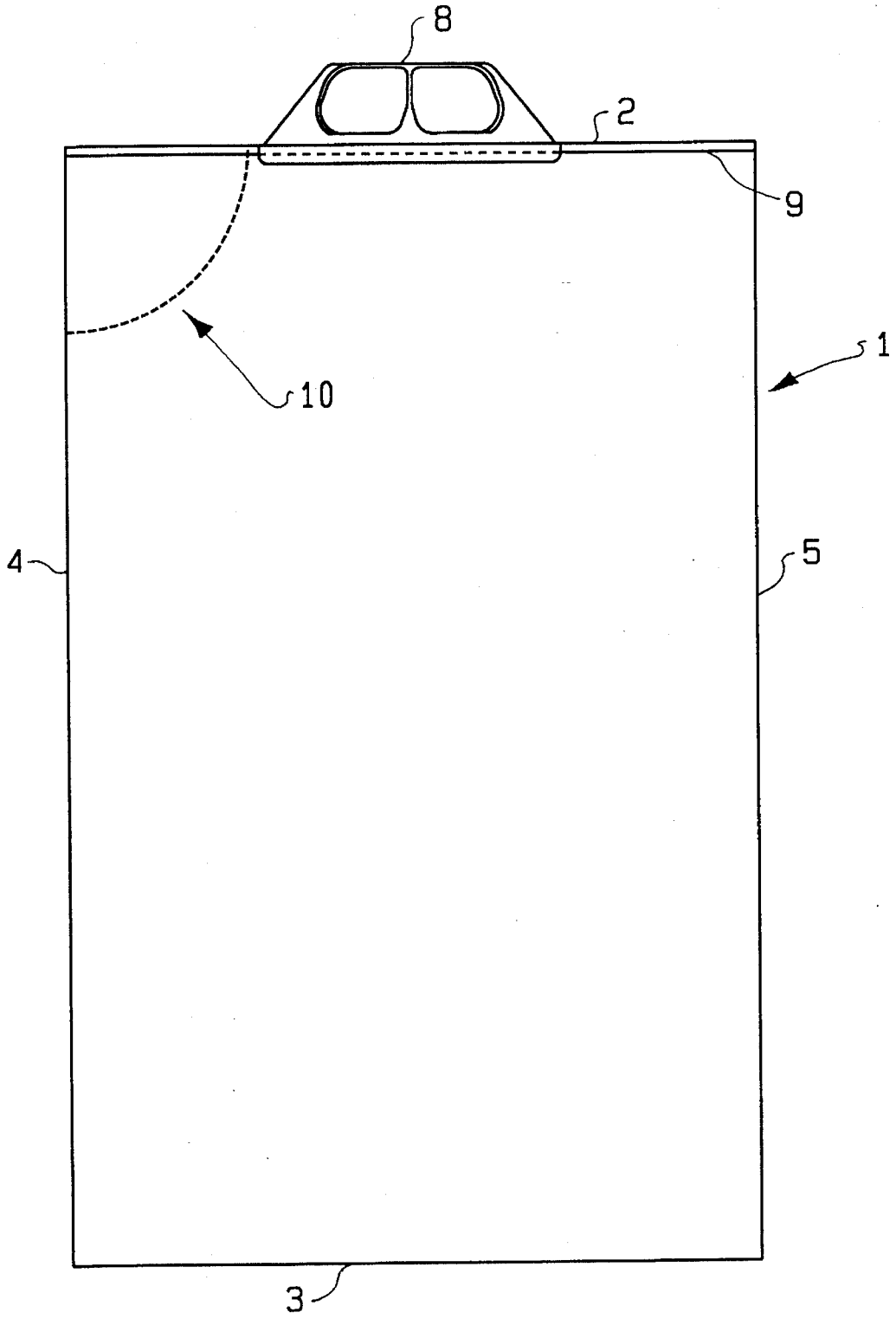
FIG. 1 is a front view of the preferred embodiment of the present invention.

As shown in the drawings, the bag 1 is generally of rectangular shape. It includes an upper edge 2, a lower edge 3, side edges 4, 5 and front and back faces 6 and 7. A handle 8 is secured to the top edge of the bag.

The bag is manufactured by extruding plastic into a tubular shape. The tubular shape is cut transversely at the lengths desired for the bag. In the embodiment shown in FIG. 1, the bag is constructed for holding salt pellets for use in household water softening equipment. The bag has a width of about 15 to 22 inches and a length of about 20 to 32 inches. The bag is made from a suitable polyolefin film, such as high density, low density or linear low density polyethylene, polypropylene, rubber modified high density polyethylene or mixtures of the above. The bag has a thickness of between about 3 and 9 mils. A bag of this construction is adapted to hold 40 pounds to 80 pounds of salt pellets or similar materials with the size of the pellets ranging up to about two inches in cross-sectional dimension.

Figure 2:
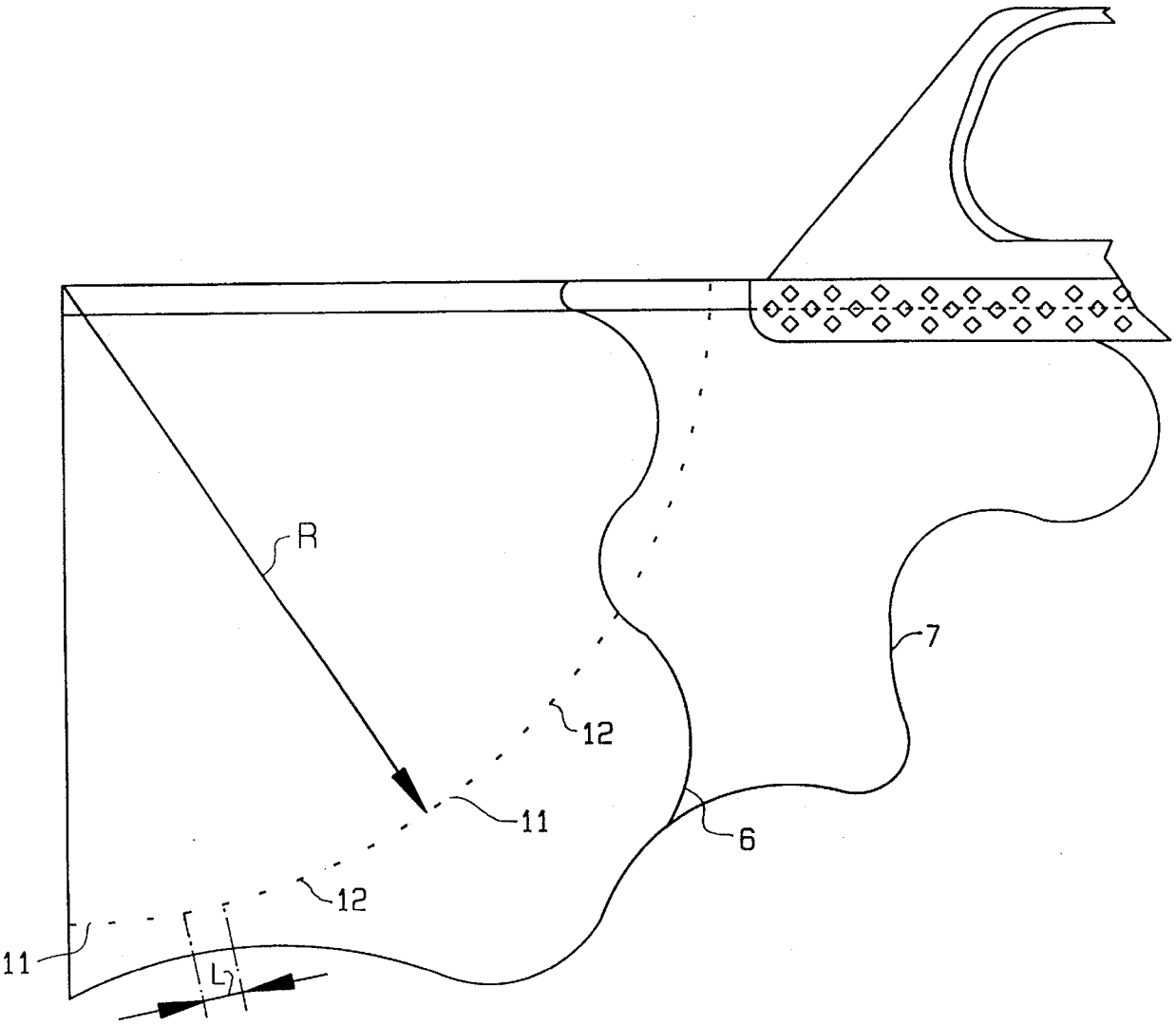
FIG. 2 is a partial cross-sectional view, on an enlarged scale, of the bag in the area of the tear line.

In the embodiment of the bag shown in FIGS. 1 and 2, the bag has a width of 15½ inches and a length of 24½ inches. Such a bag is adapted to hold 40 pounds of salt pellets.

Bags of a larger size are also possible. Bags may be adapted to contain from about 20 pounds to about 150 of product. The larger bags would typically not include a handle.

In making the bag from the tubular extrusion, the upper edge is initially sealed along the seal line 9. This is typically done by heat sealing. The bottom edge 3, on the other hand, is left open for filling purposes. After filling with a product, the bag is sealed along the edge 3 by conventional means such as heat sealing.

Alternatively, the bag may be manufactured by center-folding plastic film and side sealing and cutting the bag transversely at the widths desired for the bag.

In accordance with the teachings of the present invention the bag is provided with a tear line generally designated at 10. This tear line is formed in the bag prior to filling. In construction, the tear line is substantially arcuate in shape. As shown in FIG. 1, it is positioned in the upper corner of the bag and extends from the upper edge 2 to the side edge 4. The perforations are cut in a single line of cut and uncut segments from the front face 6 and through the back face 7 of the bag.

The plastic material of the bag generally has a machine direction and a cross direction. The machine direction is the direction in which the plastic material is formed and the cross direction extends at right angles to the machine direction. In the preferred embodiment shown in FIGS. 1 and 2, the perforations at one end of the tear line run substantially in the machine direction and substantially in the cross direction at the other end of the tear line.

The tear line may be formed substantially of an arcuate shape. The radius of curvature of the arcuate shape in preferably about 1 inch to about 6 inches, more preferably about 3 to about 6 inches. The arcuate shape may form all or substantially all of the tear line. By substantially, it is meant that the arcuate shape is about 20% or more of the length of the tear line. In a preferred embodiment, the arcuate shape is about 40% or more of the length of the tear line. In a more preferred embodiment, the arcuate shape is about 70% or more of the length of the tear line. In a still further preferred embodiment, the arcuate shape is 90% or more of the length of the tear line. In another preferred embodiment, the tear line is entirely formed by an arcuate shape with the center of radius being at the corner of the bag or beyond the bag.

FIG. 2 shows the tear line on an enlarged scale. In the 40 pound bag shown in FIG. 1, the tear line is formed as an arc with a radius R of 4 inches extending from the upper left hand corner of the bag. With a larger 80 pound bag the radius R of the arc of perforations is preferably 5 inches. With both sizes of bags, the perforations include uncut segments 11 and cut segments 12. In the embodiment shown in FIGS. 1 and 2, the ratio of the uncut segments to the cut segments is about 75% uncut to 25% cut. The combined length of each set of uncut-cut segments is about 0.1 to 0.4 inch. In a preferred embodiment shown in FIGS. 1 and 2, the uncut-cut segment is about 0.25 inch. With reference to FIG. 2, this length is shown by the dimension L. The dimension L is used to determine the ratio of uncut to cut segments of the perforation. Therefore, for a ratio of 75% uncut to 25% cut, 75% of the length L is uncut and 25% is cut.

The shape and size as well as the spacing between the cut and uncut portions of the perforations is important in providing a bag which is both resistant to mishandling and dropping as well as easy to open by the user.

As stated above, the plastic material has a machine direction and a cross direction perpendicular to the machine direction. It is easier to tear such a material in the machine direction. When perforating such a material, it has now been found that using a larger uncut ratio in the machine direction maintains strength while providing an easy tear line. It has further been found that using a smaller uncut ratio in the cross direction maintains strength while providing an easy tear line.

It has further been discovered that a uniformly tearing perforation may be formed wherein the perforations running substantially in the machine direction have a higher uncut ratio than the perforations running substantially in the cross direction. With the bag shown in FIGS. 1 and 2, the machine direction of the plastic material runs parallel to the length of the bag, that is, parallel to the side edges 4 and 5, while the cross direction runs parallel to the top and bottom edges 2 and 3. Therefore, the perforations in the upper right hand part of the tear line 10, as shown in FIGS. 1 and 2, run in the machine direction while the perforations in the lower left hand part of the tear line run in the cross direction. One skilled in the art can readily determine machine direction and cross direction of plastic material.

The uncut ratio of the perforations may vary step-wise in one or more increments through the path of the tear line. In a preferred embodiment, the uncut ratio may vary continuously so that virtually each cut section in a tear line perforation will vary from the one next to it with the cut section gradually increasing or decreasing through all or a portion of the tear line perforation. In this way, the force needed to tear the bag open can be made to be substantially constant along the entire tear line. This, in turn, makes it easier for the user to open the bag.

Typically the perforation will have a ratio of uncut and cut segments along the tear line of about 80% uncut to 20% cut to about 40% uncut to 60% cut. Preferably, the ratio along the tear line will be about 80% uncut to 20% cut to about 50% uncut to 50% cut. More preferably, a uniform ratio along the tear line will be about 78% uncut to 22% cut.

The higher ratio of uncut to cut segments would be suitable for thinner materials and also for use along the machine direction of the plastic material. The ratio of uncut to cut can be advantageously reduced as the tear line proceeds from the machine direction to the cross direction. For example, a presently preferred embodiment of a tear line with a varying ratio of uncut to cut is one in which the ratio starts out at 80% uncut to 20% uncut in the machine direction at the top edge 2 of the bag and is uniformly changed along the tear line to end with a ratio of 70% uncut to 30% cut in the cross direction of the material at the side edge 4 of the bag.

The load carrying bag may further be equipped with a handle 8 on one or more edges. The handle may be attached or formed from the bag material.

The bag may also be perforated so that the tear line extending along each of the front and back faces of the bag does not extend to one edge of the bag leaving an unperforated strip of plastic material between portions of the bag on one end of the perforation. This allows the corner of the bag to remain attached to the bag after opening, permitting easy disposal and recycling of the bag after use.

The particular constructions described above have been compared in tests against perforated tear lines of different shapes and dimensions. These comparisons have been made with respect to a tear line that runs on a straight line diagonally across the corner of the bag and a tear line which is L-shaped with one leg of the L extending from the top edge of the bag, the other leg from the side of the bag, and the tear line defining a small curve just sufficiently large enough to round out the sharp right angle at the corner of the L, opposite the bag corner. Also, comparisons have been made with respect to perforations having different ratios of uncut to cut segments.

Although the other constructions have passed some of the tests to which the bags are subjected, none has been found to pass all tests. For example, the bags with the constant 90:10 ratio of uncut to cut segments, all passed the drop test to which the bags were subjected. However, none of them could be torn open by hand.

With respect to thicker material bags with a constant ratio of 80:20 of uncut to cut segments, the bags would tear properly in the machine direction but not in the cross direction. Of the bags tested with a constant 75:25 ratio, those constructed with a straight angle tear line failed to pass the drop tests although they were easily opened by hand. Only the arc-shaped construction of the present invention passed the drop tests and was also easily opened by hand.

Comparing bags with the arcuate shaped tear line of the present invention to bags with the L-shaped tear line with both types of bags having a ratio of 75:25 of uncut to cut segments, the test results showed that both pass the drop test and were easily opened. However, with the L-shaped tear line, the perforation did not tear evenly at the small radius in the corner of the L. The bag tends to tear along a straight line instead of following the perforation. With the arc-shaped construction, the tear ran smoothly along the arc no matter how the user positioned his hands. Also, in comparing bags with a 50:50 ratio of the cut to uncut segments, the drop tests were passed and the bags were easy to open. Loose powder tended to escape through the perforations upon impact of the bag. This is an acceptable result.

The results obtained with the tests as outlined above were surprising. First of all, it was not expected that bags of this construction which are adapted to carry heavy loads could be provided with any type of perforation which would permit mishandling and dropping and yet be easy to open manually by the ultimate user. This was, in fact, borne out by all perforated tear line constructions except that of the present invention. This was not expected and the reasons for the success with the present invention are not completely understood. Nevertheless, the present invention does provide a solution to the expected problems with perforated tear lines, which in the past have been thought to be insurmountable in bag constructions adapted to carry substantial loads. Additionally, the arcuate shape of the perforation allows the contents of the bag to exit freely. Once the bag is opened, the arcuate perforation at the corner of the bag tends to define a circular-like opening as the weight of the contents acts on the opening when the bag is inverted.

We claim:

1. In a load carrying sealed bag carrying a load of contents and having a top sealed edge, a bottom sealed edge, opposite side sealed edges and overlying front and back faces and constructed of plastic material of a thickness between about 3 and 9 mils and said bag further having a size of at least as big as about 12 inches wide along said top edge and 15 inches alone said side edges, the improvement comprising:

a) a tear line extending along each of the front and back faces of said bag between said top edge and a side edge, each tear line being defined substantially by an arcuate shape defined, in turn, by a line of perforations comprised of uncut and cut segments to define a ratio of uncut to cut segments; said perforations having a ratio of uncut and cut segments along said tear line of between about 80% uncut to 20% cut and 40% uncut to 60% cut.

2. The improvement in a load carrying bag according to claim 1 wherein:

the arcuate portion of the tear line is at least 20% of the total length of the tear line.

3. The improvement in a load carrying bag according to claim 1 wherein:

the perforations have the same uncut to cut ratio over the entire tear line.

4. The improvement in a load carrying bag according to claim 3 wherein:

the perforations have a constant uncut to cut ratio of about 75% to 25%.

5. In a bag for carrying a load and having a top edge, a bottom edge opposite side edges and overlying front and back faces and constructed of plastic material, the improvement comprising:

a) a tear line extending along each of the front and back faces of said bag between said top edge and a side edge, each tear line being defined substantially by an arcuate shape defined, in turn, by a line of perforations;

b) the perforations of the tear line are comprised of uncut and cut segments to define a ratio of uncut to cut segments;

c) the plastic material has a machine direction and a cross direction and the perforations at one end of the tear line run substantially in the machine direction and substantially in the cross direction at the other end of the tear line;

d) the transition from machine direction to cross direction occurs through an arcuate shaped portion of the tear line; and e) the perforations running substantially in the machine direction have a higher uncut to cut ratio than the perforations running substantially in the cross direction.

6. The improvement in a load carrying bag according to claim 5 wherein:

the perforations have a ratio of uncut and cut segments along said tear line of about 80% uncut to 20% cut to about 40% uncut to 60% cut.

7. The improvement in a load carrying bag according to claim 6 wherein:

the perforations have a ratio between uncut and cut segments along said tear line of about 78% uncut to 22% cut to about 60% uncut to 40% cut.

8. The improvement in a load carrying bag according to either one of claims 4 or 7 wherein:

the bag has a width of about 15 to 22 inches and a length of about 20 to 32 inches and the tear line with an arcuate shaped portion with a radius of about 1 to 6 inches.

9. The improvement in a load carrying bag according to either one of claims 4 or 7 wherein:

said plastic material is a polyolefin film.

10. The improvement in a load carrying bag according to claim 9 wherein:

said plastic material is selected from the group consisting of high density polyethylene, low density polyethylene, linear low density polyethylene, polypropylene, rubber modified high density polyethylene and mixtures thereof.

11. The improvement in a load carrying bag according to claim 9 wherein:

said plastic material is linear low density polyethylene.

12. The improvement in a load carrying bag according to either one of claims 4 or 7 wherein:

the thickness of said plastic material is about 6 mils to about 8 mils.

13. The improvement in a load carrying bad according to either one of claims 4 or 7 wherein:

the tear line extending along each of the front and back faces of the bag does not extend to one edge of the bag leaving an unperforated strip of plastic material between portions of the bag on one end of the tear line perforation.

14. The improvement in a load carrying bag according to claim 13 further comprising a handle on at least one edge of the bag.

15. The improvement in a load carrying bag according to either one of claims 4 or 7 wherein:

said arcuate shape has a radius of between about 1 and 6 inches.

16. The improvement in a load carrying bag according to claim 15 wherein:

said arcuate shape has a radius of between about 4 and 5 inches.

17. The improvement in a load carrying bag according to claim 5 wherein:

each adjacent uncut-cut segment of said tear line is about 0.1 to about 0.4 inch in length.

18. The improvement in a load carrying bag according to claim 5 wherein:

the ratio of uncut to cut segments of the perforations varies along the tear line from a first ratio to a second ratio smaller than said first ratio as the tear line proceeds from the machine direction to the cross direction of the plastic material to define a tear line requiring a substantial uniform force to effect tearing of the tear line along its entire length.

19. The improvement in a load carrying bag according to claim 18 wherein:

the ratio of uncut to cut segments of the perforations varies from 80% uncut, 20% cut to 70% uncut, 30% cut.

20. In a bag for carrying a load and having a top edge, a bottom edge, opposite side edges and overlying front and back faces and constructed of plastic material, the improvement comprising:

a) a tear line extending along each of the front and back faces of said bag between said top edge and a side edge, each tear line being defined substantially by an arcuate shape defined, in turn, by a line of perforations;

b) the perforations of the tear line are comprised of uncut and cut segments to define a ratio of uncut to cut segments; and c) the perforations have at least two ratios of uncut and cut segments along said tear line.

21. The improvement in a load carrying bag according to claim 20 wherein:

the arcuate portion of the tear line is about 90% of the total length of the tear line.

22. In a bag for carrying a load and having a top edge, a bottom edge, opposite side edges and overlying front and back faces and constructed of plastic material, the improvement comprising:

a) a tear line extending along each of the front and back faces of said bag between said top edge and a side edge, each tear line being defined substantially by an arcuate shape defined, in turn, by a line of perforations;

b) the perforations of the tear line are comprised of uncut and cut segments to define a ratio of uncut to cut segments; and c) the perforations have a continuously varying ratio of uncut and cut segments along said tear line.

23. In a bag for carrying a load and having a top edge, a bottom edge, opposite side edges and overlying front and back faces and constructed of plastic material, the improvement comprising:

a) a tear line extending along each of the front and back faces of said bag between said top edge and a side edge, each tear line being defined substantially by an arcuate shape defined, in turn, by a line of perforations;

b) the perforations of the tear line are comprised of uncut and cut segments to define a ratio of uncut to cut segments;

c) the plastic material has a machine direction along which it has been formed and a cross direction extending at a right angle to the machine direction, with the plastic material being easier to tear along the machine direction than along the cross direction and the tear line extending in a varying direction relative to said machine and cross directions; and d) the ratio of uncut segments of the perforations varies along the tear line as the direction of the tear line varies relative to said machines and cross directions to define a tear line requiring a substantial uniform force to effect tearing of the tear line along its entire length.

24. In a load carrying sealed bag carrying a load of contents of at least about 35 pounds and having a top sealed edge, a bottom sealed edge, opposite side sealed edges and overlying spaced front and back faces and constructed of plastic material of a thickness between about 3 and 9 mils and said bag further having a size, of at least as big as about 15 inches wide along said top edge and 20 inches along said side edges, the improvement comprising:

a) a tear line extending along each of the overlapping spaced front and back faces of said bag between said top edge and a side edge, each tear line being defined substantially by an arcuate shape defined, in turn, by a line of perforations comprised of uncut and cut segments overlying each other on the front and back faces and defining a ratio of uncut to cut segments of between about 80% uncut to 20% cut and 60% uncut to 40% cut; and b) each adjacent uncut-cut segment of said tear line being about 0.1 to about 0.4 inch in length; and c) said arcuate shape having a radius of about 3 to 6 inches.

25. In a bag for carrying a load and having a top edge, a bottom edge, opposite side edges and overlying front and back faces and constructed of plastic material of a thickness between about 3 and 9 mils and said bag further having a size, of at least as big as about 12 inches wide along said top edge and 15 inches along said side edges, the improvement comprising:

a) a tear line extending along each of the front and back faces of said bag between said top edge and a side edge, each tear line being defined substantially by an arcuate shape defined, in turn, by a line of perforations comprised of uncut and cut segments to define a ratio of uncut to cut segments;

b) said tear line extending along each of the from and back faces of the bag terminates at a location spaced from one edge of the bag leaving an unperforated strip of plastic material between said location and said one edge; and c) the perforations have a ratio of uncut and cut segments along said tear line of between about 80% uncut to 20% cut and 40% uncut to 60% cut.

26. The improvement in a load carrying bag according to any one of claims 20, 22, 21, 23 and 5 wherein:

said bag is constructed of plastic material of a thickness between about 3 and 9 mils and said bag further having a size of at least as big as about 12 inches wide along said top edge and 15 inches along said side edges.

* * * * *